US009079051B2

(12) United States Patent
Woo

(10) Patent No.: US 9,079,051 B2
(45) Date of Patent: Jul. 14, 2015

(54) MASK COVER ASSEMBLY

(75) Inventor: Jae Jong Woo, Seoul (KR)

(73) Assignees: Jae Jong Woo, Seoul (KR); Gwang Heon Lee, Uijeongbu-si, Gyeonggi-do (KR)

( * ) Notice: Subject to any disclaimer, the term of this patent is extended or adjusted under 35 U.S.C. 154(b) by 929 days.

(21) Appl. No.: 13/266,500

(22) PCT Filed: Jun. 16, 2009

(86) PCT No.: PCT/KR2009/003209

§ 371 (c)(1),
(2), (4) Date: Oct. 27, 2011

(87) PCT Pub. No.: WO2010/126195

PCT Pub. Date: Nov. 4, 2010

(65) Prior Publication Data

US 2012/0042878 A1 Feb. 23, 2012

(30) Foreign Application Priority Data

Apr. 28, 2009 (KR) ..... 10-2009-0037303

(51) Int. Cl.

| | |
|---|---|
| ***A62B 18/00*** | (2006.01) |
| ***A62B 7/00*** | (2006.01) |
| ***A41D 13/11*** | (2006.01) |
| ***A62B 18/02*** | (2006.01) |
| ***A62B 7/10*** | (2006.01) |
| ***A62B 18/08*** | (2006.01) |

(52) U.S. Cl.

CPC ..... *A62B 18/025* (2013.01); *A41D 13/1138* (2013.01); *A62B 7/10* (2013.01); *A62B 18/084* (2013.01)

(58) Field of Classification Search

CPC ..... A61M 16/06; A61M 16/0605; A61M 16/0661; A61M 16/20; A61M 16/201; A61M 16/206; A61M 16/208; A62B 7/00; A62B 7/10; A62B 9/00; A62B 9/04; A62B 18/00; A62B 18/084; A62B 18/10; A62B 18/08; A62B 23/00; A62B 23/02; A41D 13/11; A41D 13/1107; A41D 13/1123; A41D 13/1138; A41D 13/46; A41D 13/1161

See application file for complete search history.

(56) References Cited

U.S. PATENT DOCUMENTS

| | | | | | |
|---|---|---|---|---|---|
| 4,793,343 | A | * | 12/1988 | Cummins et al. | 128/204.17 |
| 4,838,262 | A | * | 6/1989 | Katz | 128/205.24 |
| 4,856,508 | A | | 8/1989 | Tayebi | |
| 4,886,058 | A | * | 12/1989 | Brostrom et al. | 128/206.12 |

* cited by examiner

*Primary Examiner* — Rachel Young
(74) *Attorney, Agent, or Firm* — Novick, Kim & Lee, PLLC; Jae Youn Kim

(57) ABSTRACT

Disclosed is a mask cover assembly wherein a mask cover body is separably assembled with an exhaust valve and a mask main body, which enables replacement of the aforementioned elements. The mask main body has a semi-spherical cap form and is provided throughout the rim of an inner surface thereof with a face contact cushion member formed by pressing cotton or gauze to have a constant thickness. The mask cover body is configured to enclose the mask main body and is integrally formed at opposite lateral positions thereof with band hanger portions. The exhaust valve body is coupled to an exhaust valve mount of the mask cover body. An exhaust valve cap, an outer filter and a thin rubber plate are axially inserted into the exhaust valve body. Additionally, a coupling member is secured to the mask main body with an inner filter interposed therebetween.

7 Claims, 5 Drawing Sheets

MASK COVER ASSEMBLY

BACKGROUND OF THE INVENTION

1. Field of the Invention

The present invention relates to a mask cover assembly in which an exhaust valve including a valve body is separably assembled to a dust proof mask main body, which enables replacement of the mask main body.

More particularly, the present invention relates to a mask cover assembly for use with a sanitary mask, a dust proof mask or other industrial masks that serve to protect a wearer from natural disasters, such as, e.g., generation of a great amount of dust due to environmental contamination, and industrial disasters, such as, e.g., generation of dust or particulate matter or toxic gas under harsh working conditions of industrial sites, in which an expensive exhaust valve can be repeatedly used, rather than being prepared as a disposable product, and a mask main body can be replaced alone when contaminated.

2. Description of the Related Art

In general, people who live in areas where dust is generated by environmental disruption, or workers who work in a variety of industrial sites, including paper mills, spinning plants, dye works, quarries and the like, which exhibit generation of a great amount of toxic matter, such as fine dust or toxic gas, are exposed to serious diseases by invasion of the toxic matter into the respiratory system. To protect the health of the people or workers from such harmful environments, various types of masks, such as dust proof masks and the like, have been used in the aforementioned industrial sites and other harmful areas.

In the event that workers have continuously inhaled such fine dust or toxic gas, the workers are liable to diseases, such as pulmonary diseases, respiratory diseases and the like. Moreover, continuous inhalation of a great amount of fine dust or toxic gas into the lungs and the respiratory system may cause fatal damage to the human body. Therefore, many workers who work in industrial sites commonly wear a variety of dust proof masks to protect their health from harmful environments.

As the dust proof masks used for the above described purposes, for example, a mask to which a purge material containing a gas proof material is attached and a mask inside which a filter paper is provided have been used. However, most of these products have a relatively high price and require frequent replacement of a dust proof material because it inevitably exhibits deterioration in function after about 10 hours or more although this lifetime varies depending on an actual working time. In addition, since most conventional dust proof masks have inferior filtering functions, disposable dust proof masks have been used in working sites that attach great importance to sanitation.

A disposable dust proof mask known in the art includes a corrugated main body formed by corrugating a filter paper, hard band hanger portions integrally formed at opposite lateral sides of the filter paper along with holding hands by ultrasonic thermal bonding, and a flexible metal wire provided at the top of the filter paper so as to be freely bendable. When in use, the metal wire can be bent to conform to the profile of the wearer's face so as to ensure that the dust proof mask comes into close contact with the wearer's face. In addition, the corrugated filter paper can be spread out to ensure that the dust proof mask uniformly comes into close contact with the nose and the bottom of the jaw, in order to achieve enhanced dust blocking efficiency.

Hereinafter, the prior art will be described in more detail.

A sanitary mask according to the prior art includes an approximately semi-spherical mask main body taking the form of a filter sheet made of gauze or non-woven fabric, and a pair of band hangers attached to the mask main body, whereby the mask main body may enclose the wearer's face including the nose, the mouth and the jaw so that the rim of the mask main body comes into close contact with the wearer's face to the maximum extent possible. However, the above described prior art sanitary mask may fail to come into close contact at the rim of the mask main body with the wearer's face because of different face profiles of respective wearers.

Moreover, since the respective wearers have differences in the profile of the face and the height and curvature of the nose, the rim of the mask main body may have a greater space with the face around the nose, which may remarkably deteriorate the functionality of the mask.

To solve the above described problems, there has been developed and used a mask, in which a sponge is attached to an inner surface of a portion of a mask main body corresponding to a facial region around the wearer's nose by means of an adhesive member layer and an adjusting member in the form of a metallic wire formed of, e.g., soft aluminum is attached to the exterior of the mask main body at a position where the sponge is attached. In a state in which the mask is worn to cover the nose, the mouth and the jaw of the wearer by means of an upper holding band and a lower holding band, if the wearer bends the adjusting member to conform to the shape of the facial region around the wearer's nose, the cushioning sponge may come into close contact with the wearer's face around the nose.

However, in the case of the above described mask in which the sponge is locally attached only to the inner surface of the portion of the mask main body that will come into contact with the facial region around the nose and the flexible adjusting member is attached to the exterior of the mask main body at the position where the sponge is attached, although it may prevent generation of a space between the mask and the wearer's face around the nose, the remaining inner surface of the mask main body except for the portion where the sponge is attached may be spaced apart from the wearer's face at irregular distances owing to the irregular profile of the wearer's face, which results in deterioration in the functionality of the mask.

In all sanitary masks and dust proof masks generally used at present, constituent components thereof including, e.g., a mask main body, a dust proof exhaust valve, a metallic wire, a band configured to be hung at the ear or to surround the back of the head, and support elements are integrally formed with one another so as to be sold and used as a unitary product. Thus, after the mask is used two times in the morning and in the afternoon (for one day), reuse of the mask is impossible and the mask is disposed of as industrial waste.

In particular, in the case of a dust proof mask equipped with an exhaust valve that is used to protect a wearer from fine dust and toxic gas in industrial sites where a great amount of dust or particulate matter is generated, despite the fact that the exhaust valve is a very high price product fabricated with high precision and is repeatedly usable plural times, the high price exhaust valve should be disposed of because it is integrally formed with a mask main body.

Korean Utility Model Registration No. 389356 issued by the applicant of the present invention discloses a sanitary mask to solve the above described problem. In the disclosed sanitary mask, a semi-spherical mask main body is provided with an upper holding band and a lower holding band to assist in wearing the mask, and an adjusting member is provided at a partial exterior portion of the rim of the mask main body so as to be bendable to conform to the shape of the wearer's nose. In addition, a cushion filter is directly attached to the entire inner surface of the mask main body inside the rim by use of an adhesive layer member so as to come into close contact with the wearer's face. With the configuration disclosed in the above registration, the sanitary mask ensures that the rim portion of the mask main body comes into close contact with the wearer's face including the nose, the mouth and the jaw with the cushion filter interposed therebetween, which may prevent air not having passed through the mask main body and the cushion filter from entering the nose and the mouth of the wearer.

However, the disclosed sanitary mask as described above has a disadvantage in that adjusting the holding band is not easy because it is designed to be hung on the ear.

SUMMARY OF THE INVENTION

Therefore, the present invention has been made in view of the above problems, and it is an object of the present invention to provide a mask cover assembly, in which a mask cover body and an exhaust valve are assembled to a mask main body provided as a disposable component, in which a face contact cushion member in the form of a multilayered cotton member is attached to an outer circumference of an inner surface of the mask main body so as to completely prevent invasion of fine dust, toxic gas and the like, in which inner and outer filters capable of strictly filtering contaminants and foul odors are installed to the exhaust valve so as to prevent deterioration in the functionality of the exhaust valve even after the exhaust valve has been repeatedly used for a long period of time and to prevent the wearer from inhaling the contaminants and foul odors, and in which the high price exhaust valve, the mask cover body and a band used to hang the mask on the wearer's face are reusable by allowing only the used mask main body to be disassembled and replaced, which results in a reduction in the price of the product.

It is another object of the present invention to provide a mask cover assembly, in which the size of a mask cover body can be adjusted by the wearer to conform to the size and the shape of the wearer's face, and in which in a state in which only a mask main body is located inside the mask cover body, an exhaust valve consisting of an exhaust valve cap and an exhaust valve body is axially inserted through an exhaust valve mounting aperture of the mask cover body and an aperture of the mask main body and is secured by means of a coupling member and thereafter, a safety shaft cap is assembled to a penetrating shaft of the exhaust valve cap to protect the wearer's face from the risk of a facial bruise.

In accordance with the present invention, the above and other objects can be accomplished by the provision of a mask cover assembly comprising a mask main body, a meshed mask cover body made of a synthetic resin material and having a semi-spherical front surface portion provided with an exhaust valve mounting aperture defined by an exhaust valve mount, and an exhaust valve provided with inner and outer filters and assembled to the mask cover body by means of a coupling member, wherein the mask main body is fitted between an exhaust valve body and the coupling member.

The mask main body, which is assembled to an inner surface of the mask cover body between the exhaust valve body and the coupling member, may be formed by laminating non-woven fabric or cotton fiber in multiple layers and pressing and securing the same to each other. A soft face contact cushion member having a constant thickness may be attached to the circumference of an inner surface of the mask main body so as to come into contact with the wearer's face. The face contact cushion member may be formed by laminating cotton or gauze in multiple layers and pressing the resulting multi-layered structure to have a thickness in a range from 5 to 8 mm, thereby serving to prevent introduction of outside air or dust.

The mask cover body may be constructed by a plurality of meshed reinforcing structures to define the exhaust valve mount and the circumferential rim for pushing the mask main body. The circumferential rim acts to push the cushion member of the mask main body against the elasticity of the band, which can suppress introduction of outside air. A pair of band hanger portions may be integrally formed at opposite lateral positions of the rim of the mask cover body to enable the mask cover body to be worn on the wearer's face by means of holding bands caught by the band hanger portions. The band hanger portions may be provided with band length adjusting holes, which ensures that the length of the mask cover body can be adjusted to come into close contact with the wearer's face.

After a penetrating shaft of an exhaust valve cap, by which the mask cover body and the main mask body are assembled to each other, is assembled with the inner and outer filters, a thin rubber plate and the exhaust valve main body, a shaft cap may be coupled to a distal end of the penetrating shaft with an inner filter interposed therebetween. The shaft cap may serve not only to prevent the penetrating shaft sharply protruding from the mask cover body from causing injury to the wearer's face upon receiving external shock, but also to prevent separation of the plurality of components assembled to the penetrating shaft of the exhaust valve cap.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
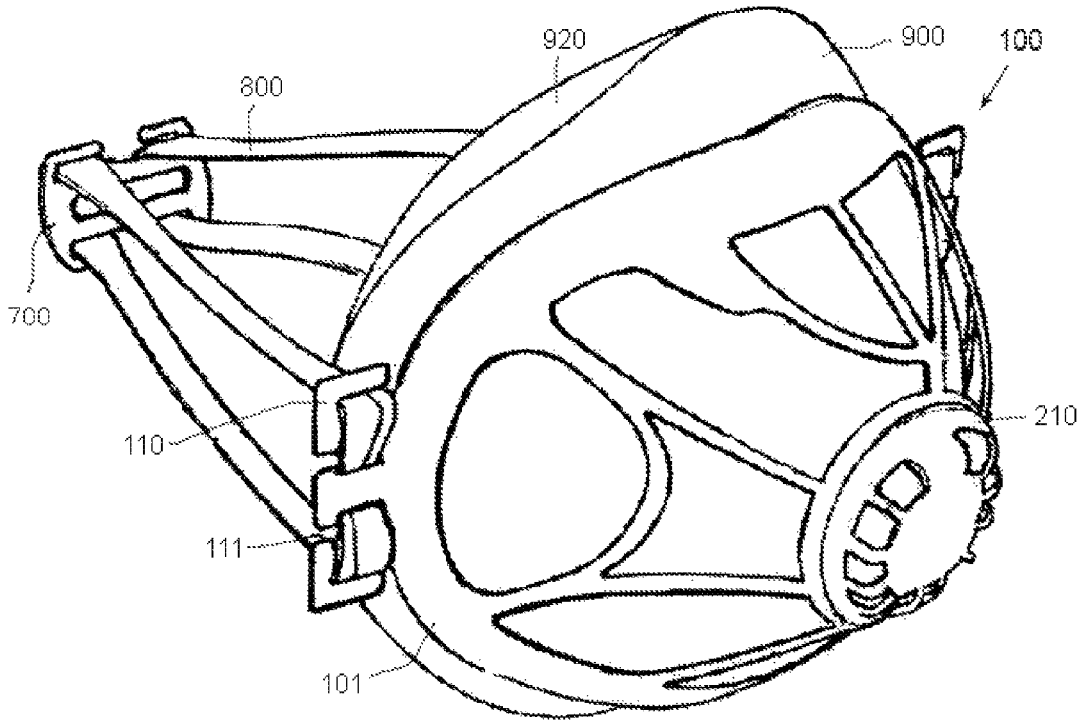
FIG. 1 is an assembled perspective view illustrating a mask cover assembly in accordance with an exemplary embodiment of the present invention in a use mode thereof.
Figure 2:
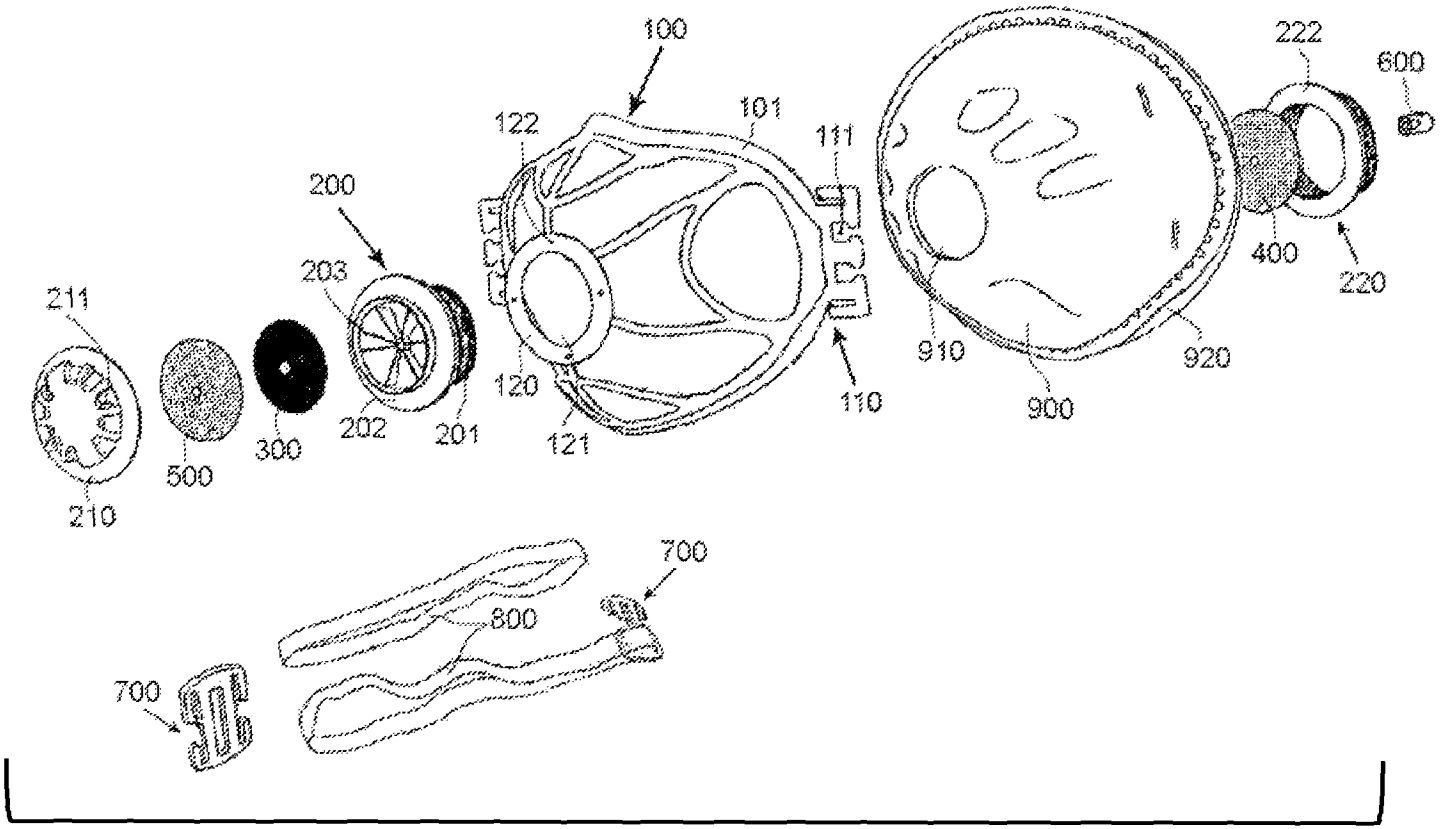
FIG. 2 is an exploded perspective view of the mask cover assembly in accordance with the exemplary embodiment of the present invention.
Figure 3:
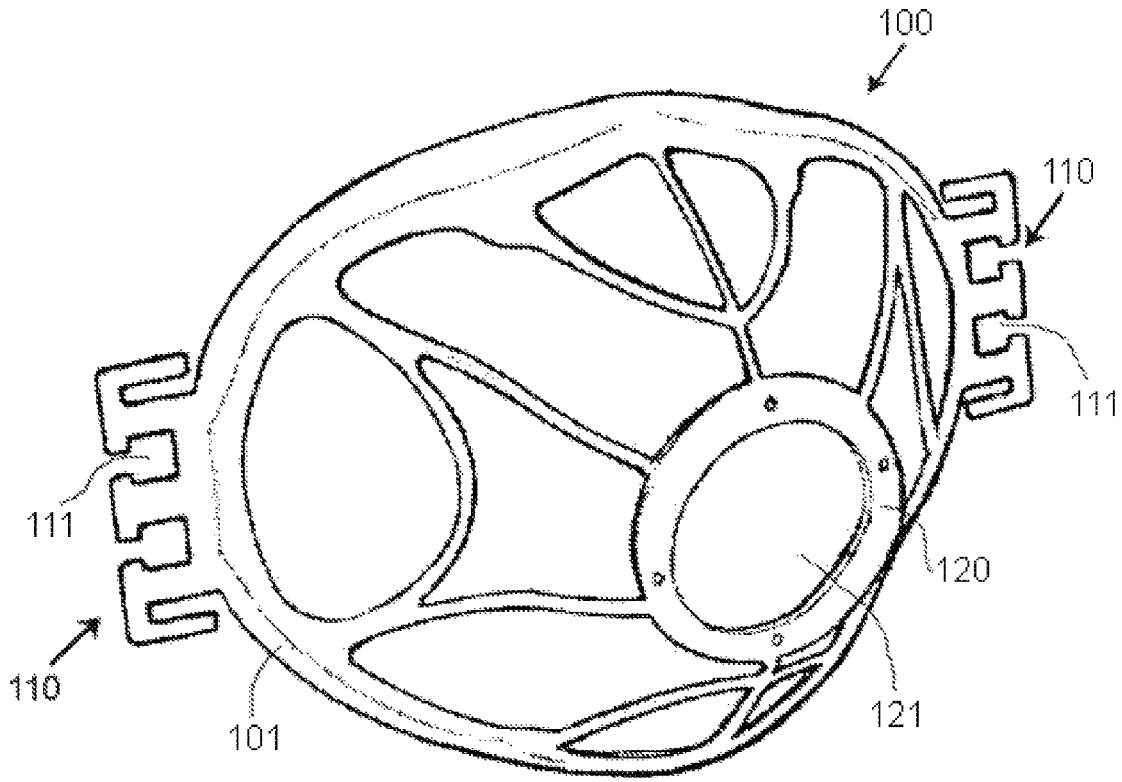
FIG. 3 is a perspective view illustrating a mask cover body as a main component of the mask cover assembly in accordance with the exemplary embodiment of the present invention.
Figure 4:
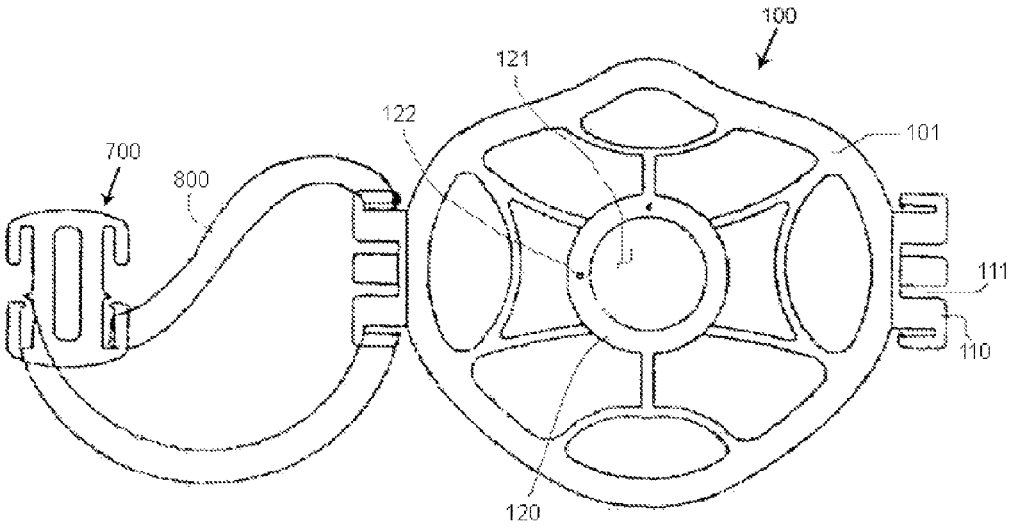
FIG. 4 is a front view of the mask cover body in accordance with the exemplary embodiment of the present invention.
Figure 5:
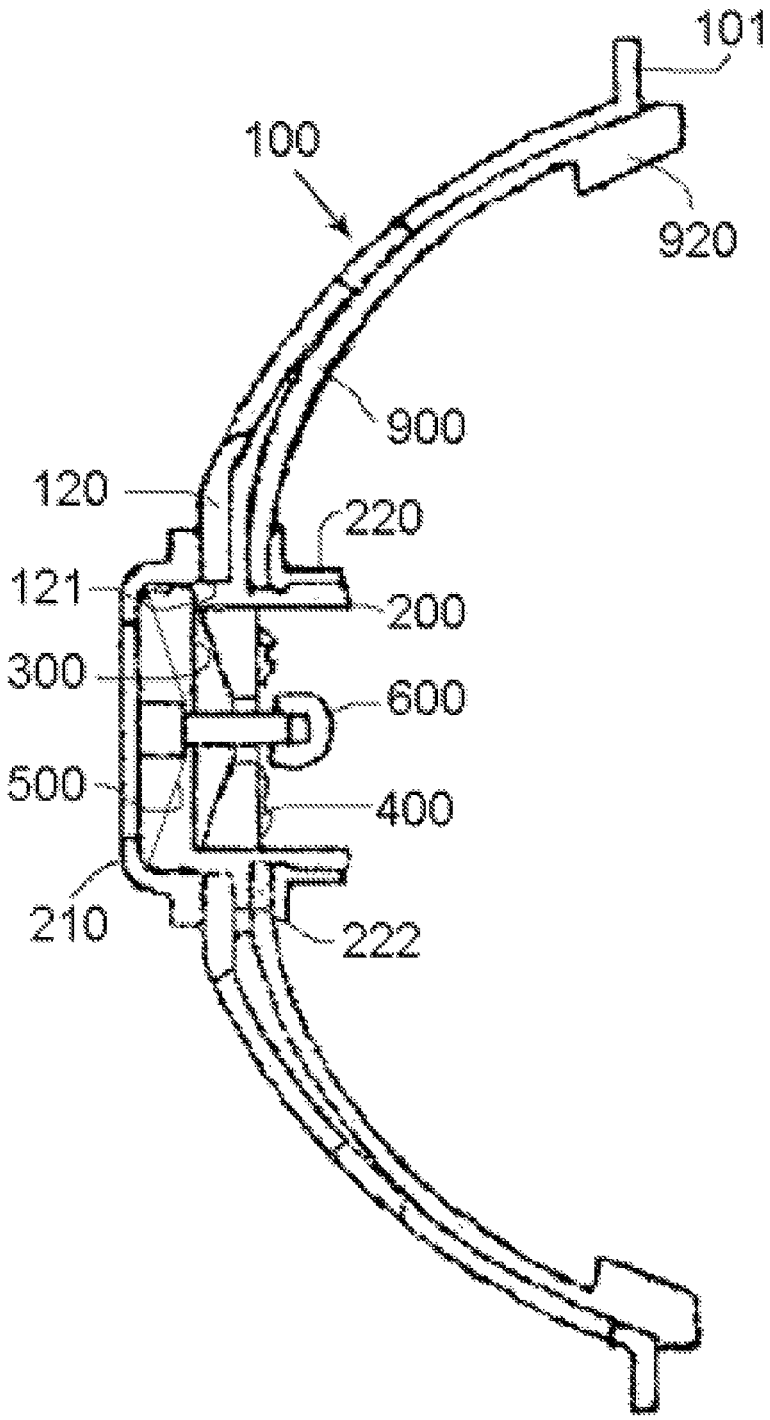
FIG. 5 is an assembled sectional view of the mask cover assembly in accordance with the exemplary embodiment of the present invention.

Hereinafter, an exemplary embodiment of the present invention will be described in detail with reference to the accompanying drawings.

In the drawings, it is noted that the same or similar elements are denoted by the same reference numerals as can as possible even though they are depicted in different drawings.

Additionally, in the following description of the present invention, a detailed description of known functions and configurations incorporated herein will be omitted when it may make the subject matter of the present invention unclear.

According to the exemplary embodiment of the present invention, an exhaust valve body 200, to which an exhaust valve cap 210, an outer filter 500 and a thin rubber plate 300 are axially coupled in sequence to constitute an exhaust valve, is axially inserted into a mask cover body 100 via a semi-spherical center exhaust valve mount 120 of the mask cover body 100. A mask main body 900 is assembled to an inner surface of the mask cover body 100 by means of a coupling member 220. A shaft cap 600 is assembled to a center penetrating shaft 211 of the exhaust valve cap 210 with an inner filter 400 interposed therebetween. The mask cover body 100 is provided at opposite lateral positions of an outer circumferential rim 101 thereof with a pair of band hanger portions 110.

The mask main body 900 takes the form of an approximately semi-spherical cap and has a center aperture 910, into which the exhaust valve body 200 is fitted. A face contact cushion member 920 is attached to an outer circumference of an inner surface of the mask main body 900. The face contact cushion member 920 is prepared by laminating cotton or gauze in multiple layers and pressing the resultant multi-layered structure to obtain a constant thickness. As such the face contact cushion member 920 may prevent generation of any slight gap between the wearer's face and the mask main body 900.

In the mask cover body 100 configured to be coupled with the mask main body 900 having the above described configuration, the center exhaust valve mount 120, which takes the form of a semi-spherical cup, defines a center exhaust valve mounting aperture 121 such that a protruding rim 202 of the exhaust valve body 200 is seated around the center exhaust valve mounting aperture 121. The exhaust valve cap 210, the outer filter 500 and the thin rubber plate 300 are sequentially inserted into a center shaft aperture 203 of the exhaust valve body 200 so as to be axially aligned. The shaft cap 600 is secured to the penetrating shaft 211 of the exhaust valve cap 210 which has passed through the center shaft aperture 203 with the inner filter 400 interposed therebetween. In the meantime, the exhaust valve body 200 is provided with an assembly threaded portion 201. Accordingly, the mask cover body 100 is axially fastened to the assembly threaded portion 201 of the exhaust valve body 200 and the assembly threaded portion 201 is tightly engaged with an inner circumference of the aperture 910 of the mask main body 900.

The mask cover body 100 has a convexly curved upper portion at a location thereof where the bridge of the wearer's nose will be located, to prevent the bridge of the wearer's nose from being pushed by the mask cover body 100. The entire mask cover body 100 takes the form of a semi-spherical cap, which allows the mask cover body 100 and the mask main body 900 provided inside the mask cover body 100 to cooperate with each other so as to construct a unitary structure. The mask cover body 100 is provided, at opposite lateral positions of the outer circumferential rim 101 on a central axis thereof, with the band hanger portions 110, and each hand hanger portion 110 is provided with band length adjusting holes 111. As such, one end of a holding band 800 can be appropriately bound to the corresponding hand hanger portion 110 in such a way that the length of the holding band 800 is adjustable using the band length adjusting holes 111. The other end of the holding band 800 is caught by a band gripper 700 that will be seated on the back of the wear's head in a worn state of the mask cover body 100. In this way, a pair of holding bands 800 can be supported at both lateral sides of the back of the wearer's head to stably hold the mask cover body 100 on the wearer's face.

In the exemplary embodiment of the present invention, the exhaust valve body 200 is assembled to the mask cover body 100 via the center exhaust valve mount 120 so that the protruding rim 202 of the exhaust valve body 200 is seated around the exhaust valve mounting aperture 121 of the center exhaust valve mount 120. In a state in which the thin rubber plate 300 and the outer filter 500 are interposed between the exhaust valve cap 210 and the exhaust valve body 200 so as to be aligned about the center shaft aperture 203, the center penetrating shaft 211 of the exhaust valve cap 210 is inserted through the center shaft aperture 203 of the exhaust valve body 200. In this case, the center exhaust valve mount 120 is provided with a plurality of recesses 122 so that bosses formed at a bottom surface of the exhaust valve cap 210 are tightly inserted into the respective recesses 122. A distal end of the penetrating shaft 211 is axially inserted through the assembly threaded portion 201 of the exhaust valve body 200. The penetrating shaft 211 can be kept stationary in place as an extended blade portion 222 of the coupling member 220 tightly pushes the inner circumference of the center aperture 910 of the mask main body 900 assembled to the inner surface of the mask cover body 100.

In the above described configuration, in a state in which the center penetrating shaft 211 of the exhaust valve cap 210 sequentially passes through the outer filter 500, the thin rubber plate 300 and the center shaft aperture 203 of the exhaust valve body 200, the inner filter 400 is axially installed to an inner surface of the assembly threaded portion 201 of the exhaust valve body 200. Then, as the shaft cap 600 is assembled to cover the end of the center penetrating shaft 211, the entire mask cover assembly in accordance with the embodiment of the present invention is completely assembled.

With regard to the functionality of the aforementioned constituent elements of the present invention, the outer filter 500, which is installed between the exhaust valve cap 210 and the thin rubber plate 300, serves to preliminary filter out fine dust or toxic gas that may be introduced during inhalation. As such, with cooperation with the thin rubber plate 300 that also serves to suppress introduction of outside dust or toxic gas, the outer filter 500 can more reliably prevent introduction of outside dust and toxic gas.

The inner filter 400, which is installed in a tubular inner space of the assembly threaded portion 201 of the exhaust valve body 200, serves not only to secondarily intercept harmful substances that may have passed through the outer filter 500 and the thin rubber plate 300, but also to prevent the working from exhaustion due to difficulty during exhalation.

In the exemplary embodiment of the present invention as described above, the mask cover body 100 is formed of a synthetic resin material and thus, exhibits good bendability. The mask main body 900, which is coupled to the mask cover body 100, is formed by pressing a fibrous material and thus, exhibits good bendability. Accordingly, the mask main body 900 can come into close contact with the wearer's face having an irregular profile due to the nose, the mouth and the jaw. Moreover, in order to allow the mask main body 900 to more precisely and safely come into close contact with the wearer's face, the face contact cushion member 920, which is formed by pressing non-woven fabric or fibers in multiple layers to have a thickness in a range from about 5 to 8 mm, is attached to the entire rim of the inner surface of the mask main body 900, which can assist the mask main body 900 in more closely coming into contact with the wearer's face.

As described above, according to the present invention, the mask cover body 100 is separably coupled with the exhaust valve and the mask main body 900 as well as the holding bands 800 used to assist in wearing the mask main body 900.

With this configuration, for example, the exhaust valve can be disassembled for the purpose of washing thereof, which enables recycling of this relatively expensive element. In addition, the mask main body 900 can be disassembled and disposed of after it wears out, and the holding bands 800 can be easily adjusted in length depending on the size of the wearer's head.

As is apparent from the above description, according to the present invention, an exhaust valve can be separably assembled to a mask cover body formed of a synthetic resin material, and the mask cover body is integrally provided at opposite lateral positions of an outer circumferential rim thereof with band hanger portions so that a pair of holding bands is connected in a length adjustable manner to band length adjusting holes of the respective band hanger portions.

With provision of the mask cover body according to the present invention, once the lifespan of the mask main body has ended, the mask main body can be separated from the mask cover body by simply unfastening a coupling member that is used to secure the mask main body to the mask cover body even in a state in which a shaft cap is not separated from a penetrating shaft of an exhaust valve cap, which assures easy replacement of the mask main body.

In addition, according to the present invention, owing to the band length adjusting holes of the band hanger portions provided at opposite lateral positions of the outer circumferential rim of the mask cover body, the wearer can appropriately adjust the length of each band to conform to the size of the wearer's head.

In particular, according to the present invention, as an outer filter is interposed between the exhaust valve cap and a thin rubber plate and an inner filter is interposed between an exhaust valve body and the shaft cap, it is possible to filter very fine dust or toxic gas that may be introduced during breathing, thereby ensuring safety of the wearer.

In conclusion, a mask cover assembly according to the present invention can provide superior functional precision and allow an expensive exhaust valve to be recyclable.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A mask cover assembly comprising:

a mask main body having a semi-spherical cap, wherein the mask main body has a center aperture and is disposed throughout a rim of an inner surface of the mask main body with a face contact cushion member formed by pressing cotton or gauze to obtain a constant thickness;

a mask cover body configured to enclose the mask main body, wherein the mask cover body is integrally formed at opposite lateral positions thereof with band hanger portions; and an exhaust valve body coupled to an exhaust valve mount of the mask cover body, wherein an exhaust valve cap, an outer filter and a thin rubber plate are axially inserted into the exhaust valve body, and wherein a coupling member is secured to the mask main body with an inner filter interposed therebetween.

2. The mask cover assembly according to claim 1, wherein the band hanger portions include band length adjusting holes to enable adjustment in the length of a band.

3. The mask cover assembly according to claim 1, wherein the exhaust valve body includes a protruding rim, which is fitted around an exhaust valve mounting aperture of the exhaust valve mount formed at the mask cover body.

4. The mask cover assembly according to claim 3, wherein the protruding rim of the exhaust valve body is configured to secure an outer filter in cooperation with the exhaust valve cap.

5. The mask cover assembly according to claim 1, wherein the exhaust valve body includes an assembly portion, which is assembled to the mask cover body so as to be secured to the mask cover body, and wherein the assembly portion has a unidirectional fastening configuration.

6. The mask cover assembly according to claim 1, wherein the exhaust valve cap is coupled to the exhaust valve mount, and the exhaust valve mount of the mask cover body and the exhaust valve cap coupled to the exhaust valve mount include respectively a plurality of recesses and bosses to prevent slippage therebetween.

7. The mask cover assembly according to claim 1, wherein the exhaust valve cap has a penetrating shaft, on which the inner and outer filters are axially inserted, and a shaft cap is disposed at a distal end of the penetrating shaft and is formed of an elastic rubber material.

* * * * *